US005209693A

United States Patent [19]

Lyman

[11] Patent Number: 5,209,693

[45] Date of Patent: May 11, 1993

[54] TOY BLOCK SET WITH DIVERSE FLEXIBLE CONNECTORS ON OPPOSING ENDS

[75] Inventor: Ronald L. Lyman, Folsom, Calif.

[73] Assignee: Fantasy Toys, Inc., Berkeley, Calif.

[21] Appl. No.: 829,302

[22] Filed: Feb. 3, 1992

[51] Int. Cl.[5] ..... A63H 33/12; A63H 33/06; A63H 33/08; F16D 1/12

[52] U.S. Cl. ..... 446/104; 446/121; 446/128; 403/157

[58] Field of Search ..... 446/102, 104, 106, 108, 446/109, 111, 115, 116, 120, 121, 122, 124, 125, 128; 403/157, 158, 159

[56] References Cited

U.S. PATENT DOCUMENTS

| | | | |
|---|---|---|---|
| 106,339 | 8/1870 | Dixon et al. | 403/159 |
| 918,225 | 4/1909 | Townley | 403/159 |
| 2,233,901 | 3/1941 | Scacchetti | 446/128 X |
| 2,990,640 | 7/1961 | Birnbaum | 446/102 X |
| 3,004,364 | 10/1961 | Benkelman | 446/124 X |
| 3,805,302 | 4/1974 | Mathys | 403/157 X |
| 4,185,410 | 1/1980 | Kristiansen | 446/104 |
| 4,214,403 | 7/1980 | Knudsen | 446/104 |
| 4,606,732 | 8/1986 | Lyman | 446/104 X |
| 4,764,144 | 8/1988 | Lyman | 446/128 |
| 4,789,369 | 12/1988 | Lyman | 446/101 |

FOREIGN PATENT DOCUMENTS

| | | | |
|---|---|---|---|
| 0367719 | 5/1990 | European Pat. Off. | 446/128 |
| 2556791 | 1/1985 | France | 446/120 |
| 8000541 | 4/1980 | PCT Int'l Appl. | 446/102 |
| 9009825 | 9/1990 | PCT Int'l Appl. | 446/102 |

*Primary Examiner*—D. Neal Muir
*Attorney, Agent, or Firm*—Harris Zimmerman

[57] ABSTRACT

Toy building blocks of the type having an array of sockets on one principal face and a matching array of projections on the opposite face that can be wedged into the sockets of another block are also joinable in an end to end relationship which enables lateral pivoting of one block in either direction relative to the block with which it is linked. In the preferred form, the opposite ends of the blocks are linkable to still other blocks in a manner which enables pivoting or flexing in an orthogonal direction. This enables assembly of interlocking blocks into a greater variety of different constructions and enables pivoting of linked portions of an assembled construction in a greater number of different directions.

15 Claims, 9 Drawing Sheets

TOY BLOCK SET WITH DIVERSE FLEXIBLE CONNECTORS ON OPPOSING ENDS

TECHNICAL FIELD

This invention relates to toy blocks which can be fitted togther to form multi-block constructions of any of a variety of configurations and more particularly to blocks of the type having means for temporarily fastening a plurality of blocks to each other.

BACKGROUND OF THE INVENTION

Traditional toy blocks are simply rested upon each other or placed adjacent each other. This greatly limits the variety of multi-block constructions that can be created and the assembly of blocks cannot be lifted and manipulated as a unit. Interlocking locking blocks which can be temporarily engaged together are not subject to these limitations and have become extremely popular.

Interlocking blocks typically have an array of openings on one major face of the block and a matching array of projections on the opposite major face. Such blocks are assembled into a unitized construction by wedging the projections of one block into the openings of an adjacent block with the blocks being in either of two orthogonal orientations relative to each other. This greatly increases the amusement and educational potentialities of toy blocks. Constructions can be assembled that would collapse if formed of unfastened blocks. The assembly of blocks can be picked up, manipulated or be moved intact to another location.

Constructions formed by assembling interlocking blocks of the original design are inflexible throughout and interconnected blocks can only be oriented in the same direction or at right angles to each other. My prior U.S. Pat. No. 4,606,732, issued Aug. 19, 1986, discloses a more versatile interlocking block configuration which has pivot couplings for linking the ends of adjacent blocks in addition to the projections and openings for rigidly interlocking the faces of stacked blocks. This enables interlocked adjacent blocks to be oriented at any of a variety of angles relative to each other and enables forming of constructions having portions which can be pivoted relative to other portions about one of more pivot axes.

The prior interlocking blocks described above require that all pivot axes in a construction be parallel. A series of interlocked blocks of the prior configuration can be flexed out of an aligned condition in one direction only. The amusement and educational potentialities of such blocks would be greatly enhanced if portions of a construction could be pivoted in one direction while other portions are pivotable in an orthogonal direction and if pivoting of initially aligned blocks in either of two opposite directions were possible.

The present invention is directed to overcoming one or more of the problems discussed above.

SUMMARY OF THE INVENTION

In one aspect of the present invention, a toy building block set includes a first block and a second block each of which has opposite principal faces, opposite sides and opposite ends. The first and second blocks each have an array of projections that extend outward from one of the principal faces and a matching array of sockets which extend inward from the other principal face, the projections and sockets having configurations which enable engagement of the block with other blocks having similar projections and sockets. The first and second blocks have first pivotable engagement means for temporarily fastening the blocks together in an end to end relationship. Such means enables alignment of the blocks and also enables sideward pivoting of one block relative to the other away from an aligned condition in each of two opposite directions, the pivoting movement being about a first pivot axis that extends in parallel relationship with the projections on the principal faces of the blocks.

In another aspect of the invention, the first and second blocks have second pivotable engagement means for temporarily fastening such blocks to other blocks in an end to end relationship, the first and second pivotable engagement means being at opposite ends of the first and second blocks. The second pivotable engagement means enables pivoting of the blocks about second pivot axes that are orthogonal to the first pivot axis.

A toy building block set in accordance with another aspect of the invention includes first and second interlockable blocks each having an array of sockets on one principal face and a matching array of projections on the other principal face which are adapted to be frictionally engaged in such sockets. A pair of resilient hinge arms extend outward from an end of one of the blocks and each arm has a knob proportioned to seat in an aperture in the corresponding side surface of one end of the other block. A pair of spaced apart blades extend outward from the opposite end of the first block to define a transversely extending slot, the blades having openings situated at corresponding locations on each blade. A transversely extending tongue projects outward from the opposite end of the second block and has a pair of detent protuberances each of which is on an opposite surface of the tongue, the protuberances being proportioned to seat in the openings of the blades when the the tongue is inserted in the slot.

In another aspect of the invention, a toy building block for releasable engagement with other blocks has a block body with an array of sockets in one principal face and a matching array of projections in the other principal face which are proportioned to be entered into sockets of that kind and to frictionally engage in such sockets. The block body has means at one end for fastening to an adjacent block which means enables pivoting of the block body relative to the adjacent block about a transverse pivot axis that extends between the sides of the block body. A pair of blades extend outward from the opposite end of the block body and are spaced apart to define a transversely extending slot. The blades have openings at corresponding locations on each blade that define another pivot axis which extends orthogonally relative to the transverse pivot axis.

In still another aspect of the invention, a toy building block for releasably engaging other blocks includes a block body with an array of sockets in one face and a matching array of projections on the other face, the projections being proportioned to enter an array of sockets of that kind and to frictionally engage such sockets. The block body has means at one end for fastening to an adjacent block in a manner that enables pivoting of the block body relative to the adjacent block about a transverse pivot axis that extends between the sides of the block body and has a transversely extending tongue which projects outward from the opposite end of the block body. Detent protuberances at corresponding locations on the opposite surfaces of the tongue define another pivot axis that extends orthogonally relative to the first pivot axis.

The invention greatly increases the variety of different constructions that can be assembled with interlocking toy blocks. Flexible constructions can be made in which a sequence of blocks are linked in end to end relationship with one or more portions of the construction being laterally pivotable in either direction relative to the adjacent portions of the construction. In the preferred form of the invention, the capability of pivoting about one or more orthogonal axes can also be built into the construction. Such constructions can be lifted, manipulated and be reformed into a number of different shapes while remaining structurally intact. Among many other possibilities, the invention enables assembly of simulations of a series of railroad cars, articulated trucks and non-rectilinear constructions such as a spiral staircase.

The invention, together with further aspects and advantages thereof, may be further understood by reference to the following description of the preferred embodiments and by reference to the accompanying drawings.

DETAILED DESCRIPTION OF THE PREFERRED EMBODIMENTS

Figure 1:
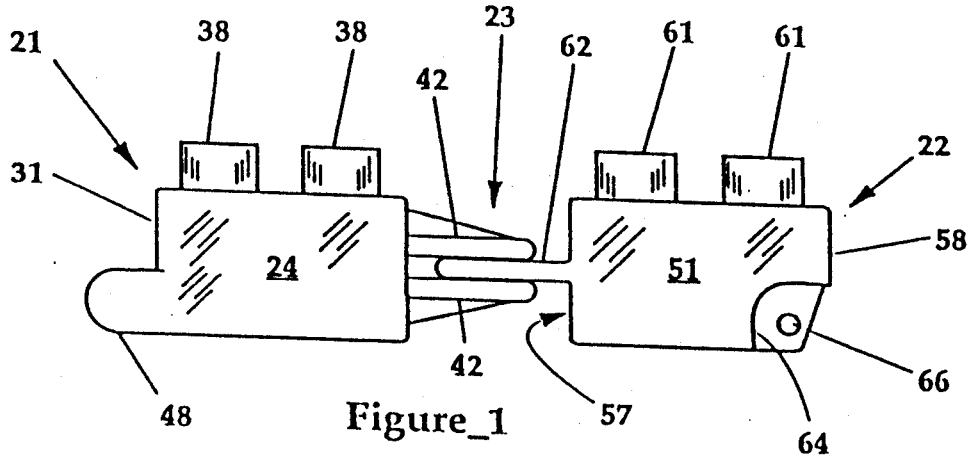
FIG. 1 is a side view of a pair of interlocking toy building blocks in accordance with a preferred embodiment of the invention.
Figure 2:
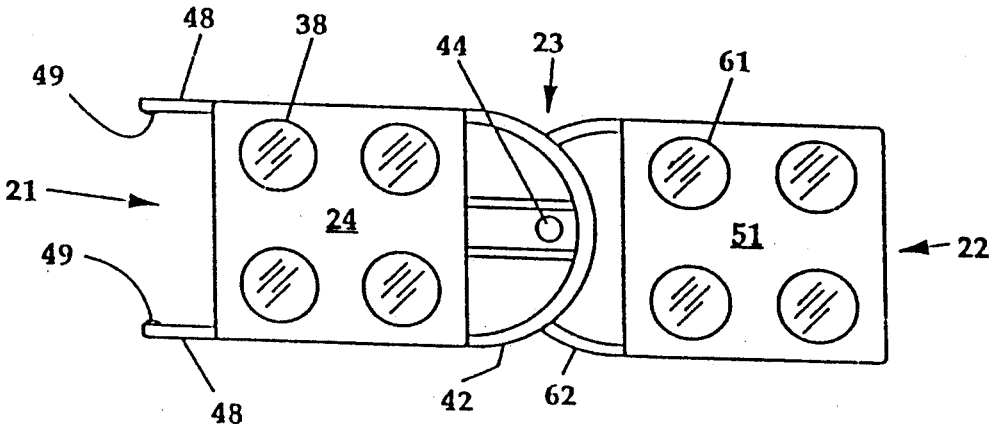
FIG. 2 is a top view of the interlocking blocks of FIG. 1.
Figure 3:
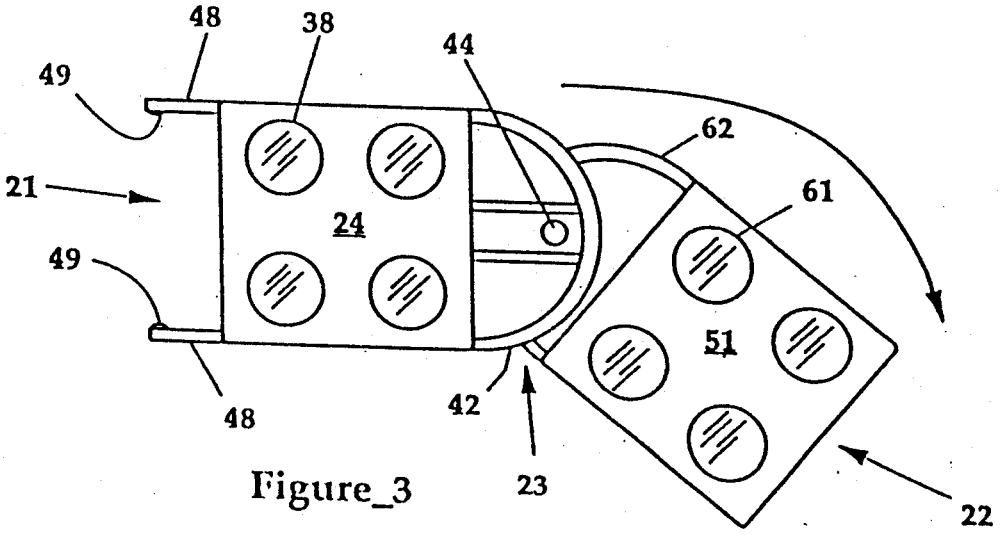
FIG. 3 is a top view of the interlocking blocks of the preceding figures illustrating one type of pivoting movement which can be realized with the blocks.
Figure 4:
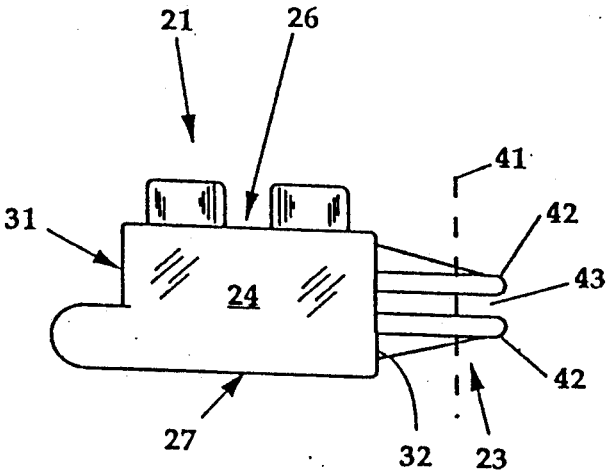
FIG. 4 is side view of a first of the component blocks of the assembly of FIG. 1.
Figure 6:
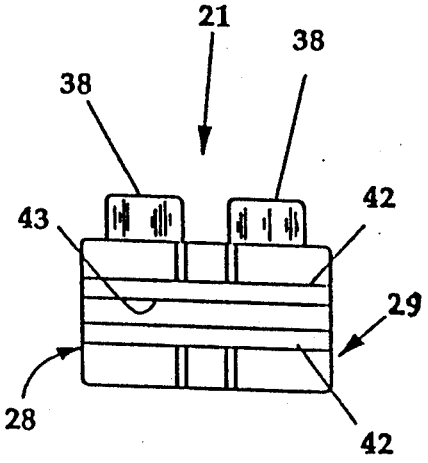
FIG. 6 is an end view of the first block.

Referring initially to FIGS. 1, 2 and 3 in conjunction, components of a toy building block set embodying the invention include a first block 21 and a second block 22 which have differing configurations and which ar interlockable with each other and with other blocks. The form of interlocking of the two blocks 21 and 22 shown in FIGS. 1 and 2, by first pivotable engagement means 23, enables sideward pivoting of either of the blocks relative to the other as depicted in FIG. 3.

A building block set will typically include a sizable number of each of the first and second blocks 21 and 22 although a single pair can be advantageously used with non-pivoting interlocking blocks of the conventional form to enable assembly of constructions having a single articulation.

Referring jointly to FIGS. 4, 5, 6 and 7, the first block 21 has a body 24 with opposite principal faces 26 and 27, opposite sides 28 and 29 and opposite ends 31 and 32. For convenience of description, face 26 will be herein referred to as the top surface of the block 21 and face 27 will be termed the underside of the block although in use the block may be inverted, placed on its side or otherwise oriented in a manner in which face 26 is not the uppermost surface.

The block body 24 is rectangular in this particular example but may have any of a variety of other configurations.

The first block body 24 is essentially hollow and open at its undersurface 27 except that four right angled and spaced apart thin panels 36 define a rectilinear array of four openings or sockets 37 at the underside of the block. A matching array of four projections 38 extend outward from the top face 26 of block body 24, the projections being cylindrical in this particular example. Projections 38 are proportioned to fit within the sockets 37 of another block in order to interlock the blocks together in a stacked relationship. Vertical ribs 39 extend along the inner walls of each socket 37 and are sized to create a frictional fit of the projections 38 within the sockets to interlock the blocks together while enabling disassembly of the blocks by application of sufficient force.

Figure 7:
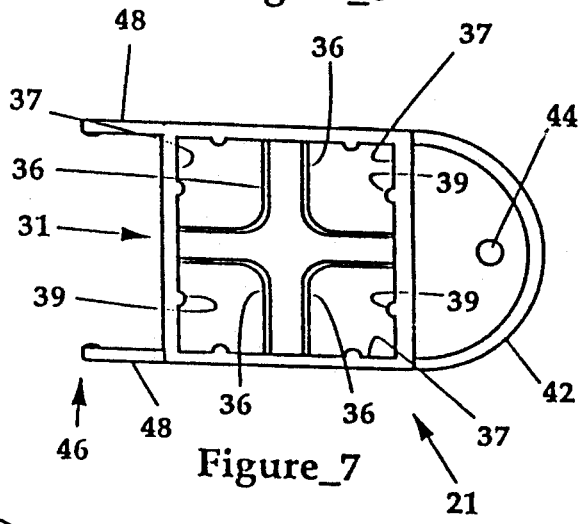
FIG. 7 is a view of the underside of the first block.
Figure 5:
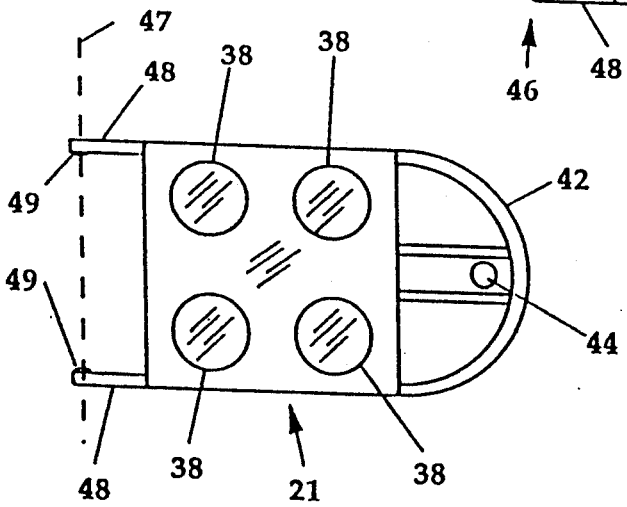
FIG. 5 is a top view of the first block.

The first pivotable engagement means 23 provides for coupling block 21 to another block in an end to end relationship in a manner which enables sideward pivoting of one block relative to the other, in either lateral direction, about a first pivot axis 41 that extends in parallel relationship with the projections 38. Components of the first pivotable engagement means 23 include a pair of spaced apart transversely extending semicircular blades 42 which project out from end 32 of the block body 24 and which jointly form a transverse slot 43 adjacent that end of the block body. As shown in FIGS. 5 and 7 in particular, each blade has a small opening 44 located outwardly from end 32 of the block body 24 and equidistantly from the sides 28 and 29 of the block body. As will hereinafter be further described, the openings 44 define the location of the first pivot axis 41.

The variety of constructions which can be assembled from the blocks is enhanced if the block 21 is also provided with second pivotable engagement means 46 at the other end 31 of block body 24. The second pivotable engagement means, which is of the type described in my prior U.S. Pat. No. 4,606,732, provides for temporarily fastening the block 21 to another block in an end to end relationship while enabling pivoting of the blocks relative to each other about a second pivot axis 47 which extends orthogonally relative to the first pivot axis 41. Components of the second pivotable engagement means 46 include a pair of hinge arms 48 which extend outward from end 31 of block body 24 at the lower corner regions of the block body, the arms being coplanar with the sides 28 and 29 of the block body. The facing surfaces of the two arms 48 each have knob projection 49 situated at the second pivot axis 47 in order to engage with another block in a manner which will hereinafter be further described.

The first block 21, including body 24, socket panels 36, projections 38, blades 42, hinge arms 48 and knobs 49, may, if desired be formed as a single integral body of plastic or other suitable material. Blades 42 and hinge arms 48 are sufficiently thin to be spreadable for a small distance and the material of which the block 21 is made is one which exhibits resiliency when it is formed into such thin configurations.

Referring now to FIGS. 8, 9, 10 and 11 in conjunction, the second block 22 also has a rectangular body 51 with opposite principal faces 52 and 53, opposite side surfaces 54 and 56 and opposite ends 57 and 58. Four sockets 59 extend into the underside face 53 and four projections 61 extend outward from the top face 52, such components being similar to those previously described in connection with the first block 21.

Figure 8:
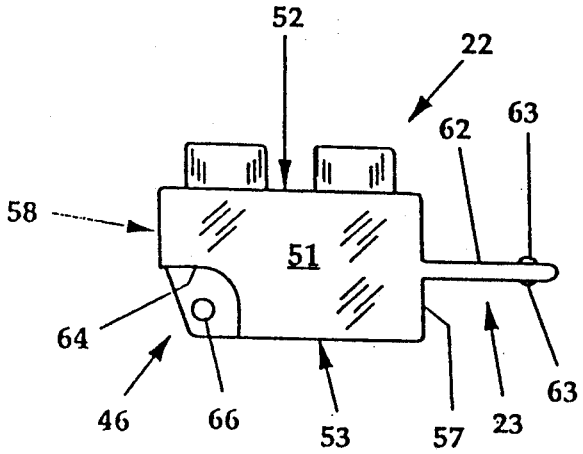
FIG. 8 is a side view of the second of the component blocks of the assembly of FIG. 1.
Figure 10:
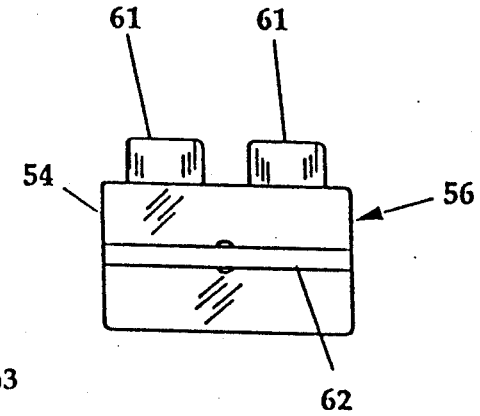
FIG. 10 is an end view of the second block.
Figure 11:
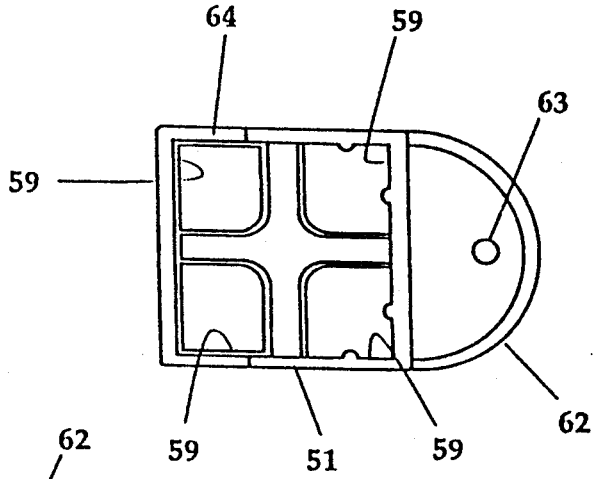
FIG. 11 is a view of the underside of the second block.
Figure 9:
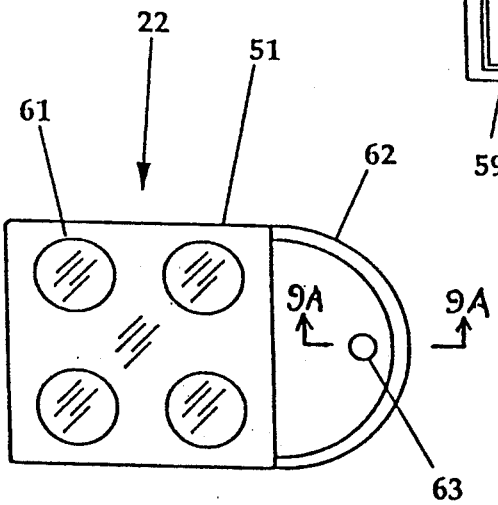
FIG. 9 is a top view of the second block.

Referring to FIGS. 1, 8 and 9, components of the first pivotable engagement means 23 further include a transversely extending semicircular tongue 62 which projects outward from one end 57 of the second block body 51, the tongue being sufficiently thin to be insertable into the transverse slot 43 formed by the blades 42 of the first block 21. Referring to FIGS. 2, 8 and 9, a small detent protuberance 63 is present at corresponding locations on the top and bottom surfaces of tongue 62. Protuberances 63 are proportioned to spread blades 42 slightly as tongue 62 is inserted between the blades and then to seat in the blade openings 44 with a snap action when the protuberances reach the location of first pivot axis 41.

Figure 9A:
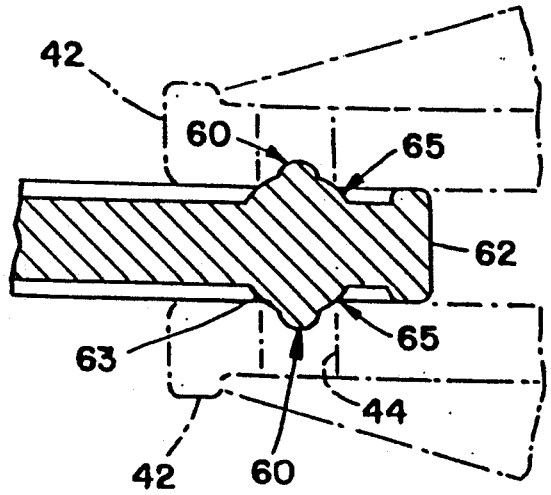
FIG. 9A is a section view taken along line 9A—9A of FIG. 9.

Referring to FIG. 9A, the protuberances 63 preferably have a double convex configuration which includes a convex tip region 60 extending from a convex base region 65 of larger diameter. This provides for a strong linkage of two blocks without inhibiting pivoting of one of the linked blocks relative to the other.

While a single protuberance 63 may serve to interlock the two blocks 21 and 22 together, the presence of two oppositely directed protuberances is preferred as it makes the coupling more resistant to unwanted disengagement by load forces acting against the principal faces of the blocks. A force of this kind which tends to pry one of the protuberances 63 out of its opening 44 simultaneously acts to urge the other protuberance into its opening.

Referring jointly to FIGS. 5, 8, 11 and 12, in order to interlock blocks 21 and 22 with the second pivotable engagement means 46, the second block 22 has a pair of recesses 64 which extend from end 58 of the block body 51 into the adjacent lover corner regions of the sides 54 and 56 of the block body. Recesses 64 are shaped to receive the hinge arms 48 of the first block 21. The block body 51 has an aperture 66 within each such recess 64 in which the knobs 49 of the hinge arms 48 seat with a snap action when the hinge arms are forced into the recesses.

Figure 13:
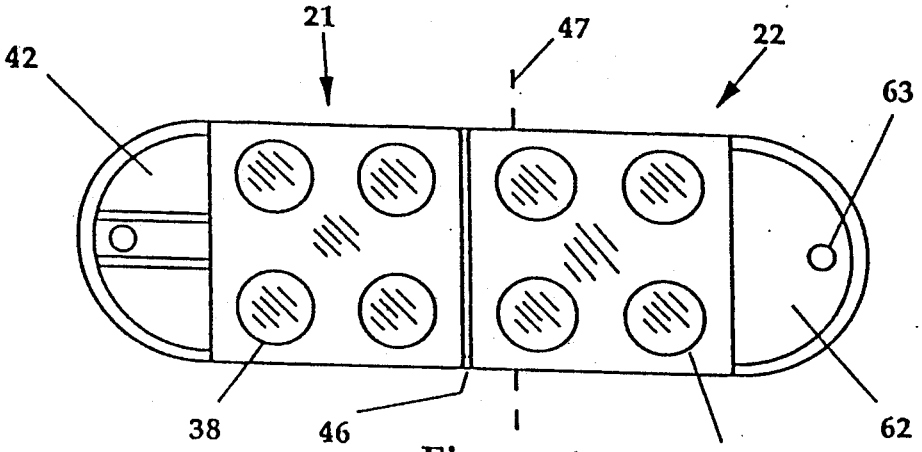
FIG. 13 is a top view of the block assembly of FIG. 12.
Figure 12:
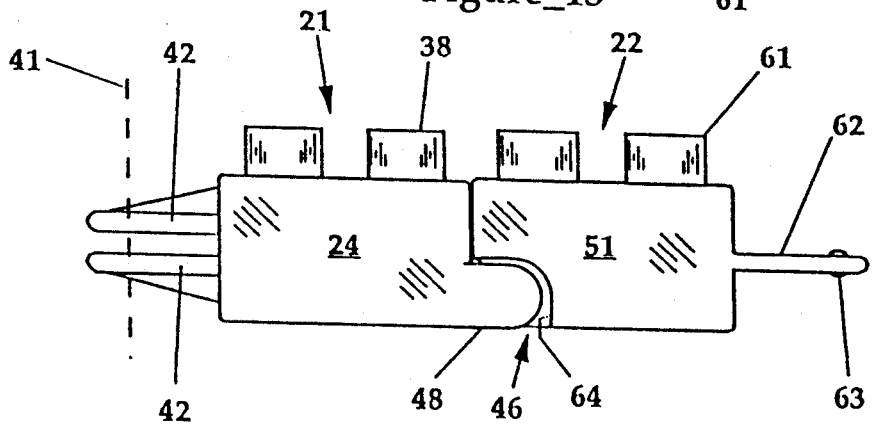
FIG. 12 is a side view of the blocks of the preceding figures shown interconnected in an alternate manner which enables pivoting in an orthogonal direction
Figure 14:
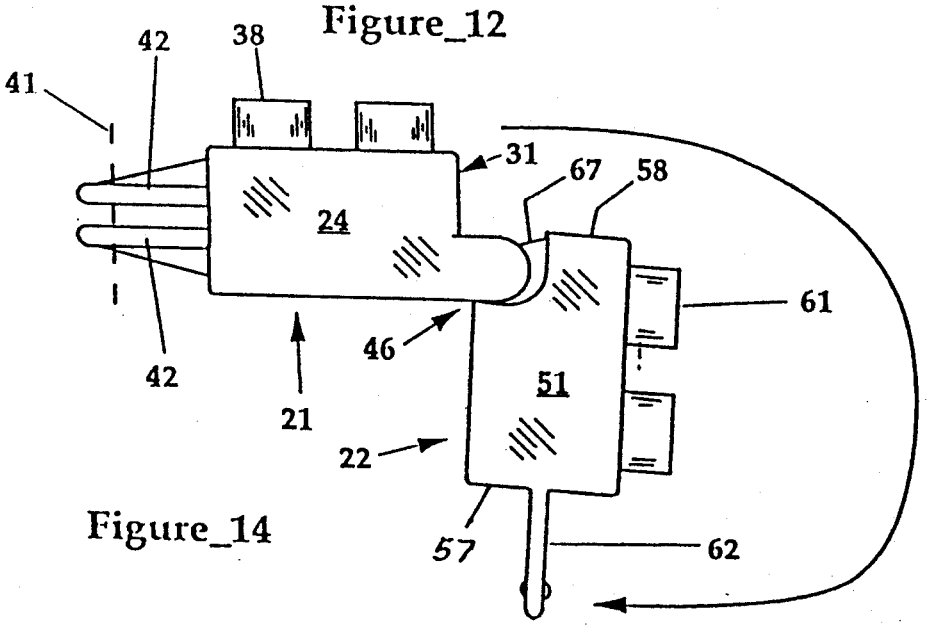
FIG. 14 is a side view of the interconnected blocks of FIGS. 12 and 13 illustrating the type of pivoting that is realized by the form of interconnection shown in FIGS. 12 and 13.

Referring to FIGS. 12, 13 and 14 in conjunction, hinge arms 48 are proportioned to hold end 31 of first block 21 and end 58 of second block 22 in abutment with each other when the blocks are aligned with each other. Thus, as the second pivot axis 47 is situated at the lower corner regions of block body 51, one block 21 or 22 cannot pivot in an upward direction relative to the other but can pivot in a downward direction as shown in FIG. 14 in particular. The lower region 67 of end 58 of the second block body 51 slants towards the opposite end 57 of the block body to avoid any interference with the pivoting motion.

Figure 15:
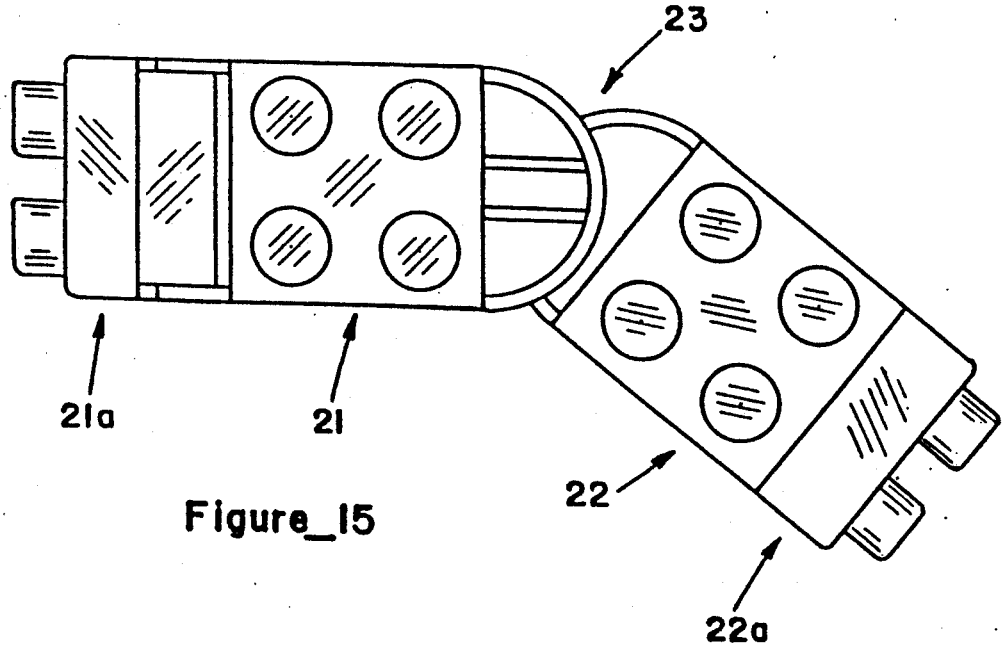
FIG. 15 depicts one form of multiply articulated construction that can be assembled with additional blocks of the type shown in the preceding figures.

The first and second blocks 21 and 22 may be interlocked in either of the two manners described above to enable pivoting about either of the two orthogonal pivot axes 41 and 47 and may be further interlocked with additional blocks to enable simultaneous pivoting about a plurality of orthogonal axes. FIG. 15, for example, illustrates a construction in which the first and second blocks 21 and 22 are engaged at the first pivotable engagement means 23 to enable sideward pivoting of one block relative the other in either direction from an aligned condition. An additional first block **21*a* is interlocked with first block 21 at the second pivotable engagement means 46 and an additional second block 22*a* is similarly interlocked with second block 22**, the additional blocks being shown pivoted at right angles to the plane of the drawing. More complex articulatable constructions of any of a virtually infinite variety of configurations may be assembled by adding additional blocks.

Figure 16:
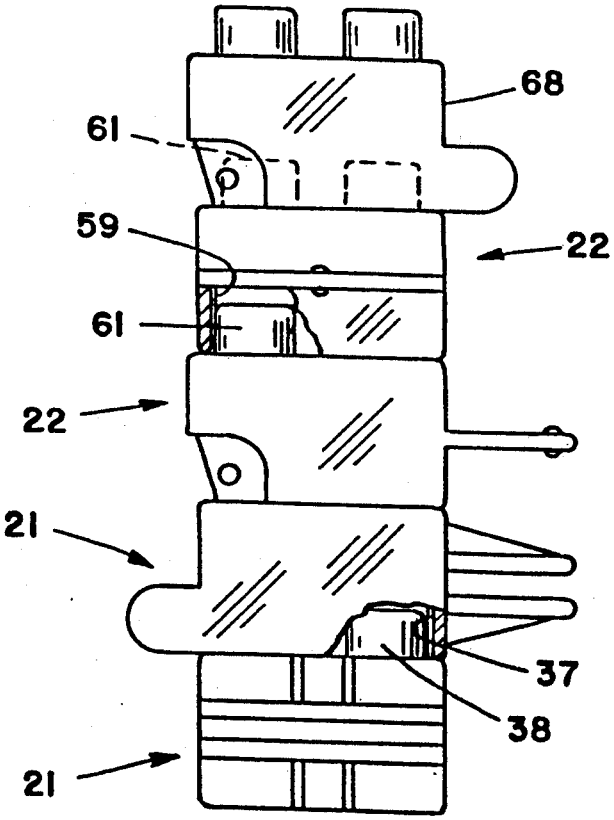
FIG. 16 depicts still another mode of interconnection of the interlocking blocks.

The blocks 21 and 22 need not necessarily be interlocked in a pivotable manner. As shown in FIG. 16, the sockets 37 and 59 and projections 38 and 61 enable a rigid interlocking of two or more blocks in a stacked or interleaved relationship such as in the assembly of constructions using conventional non-pivoting interlocking blocks. If compatibly proportioned, the sockets 37, 59 and projections 38, 61 may also be used to include other forms of interlocking blocks 68 in the construction such as the blocks of my hereinbefore identified prior U.S. Pat. No. 4,606,732.

Figure 17:
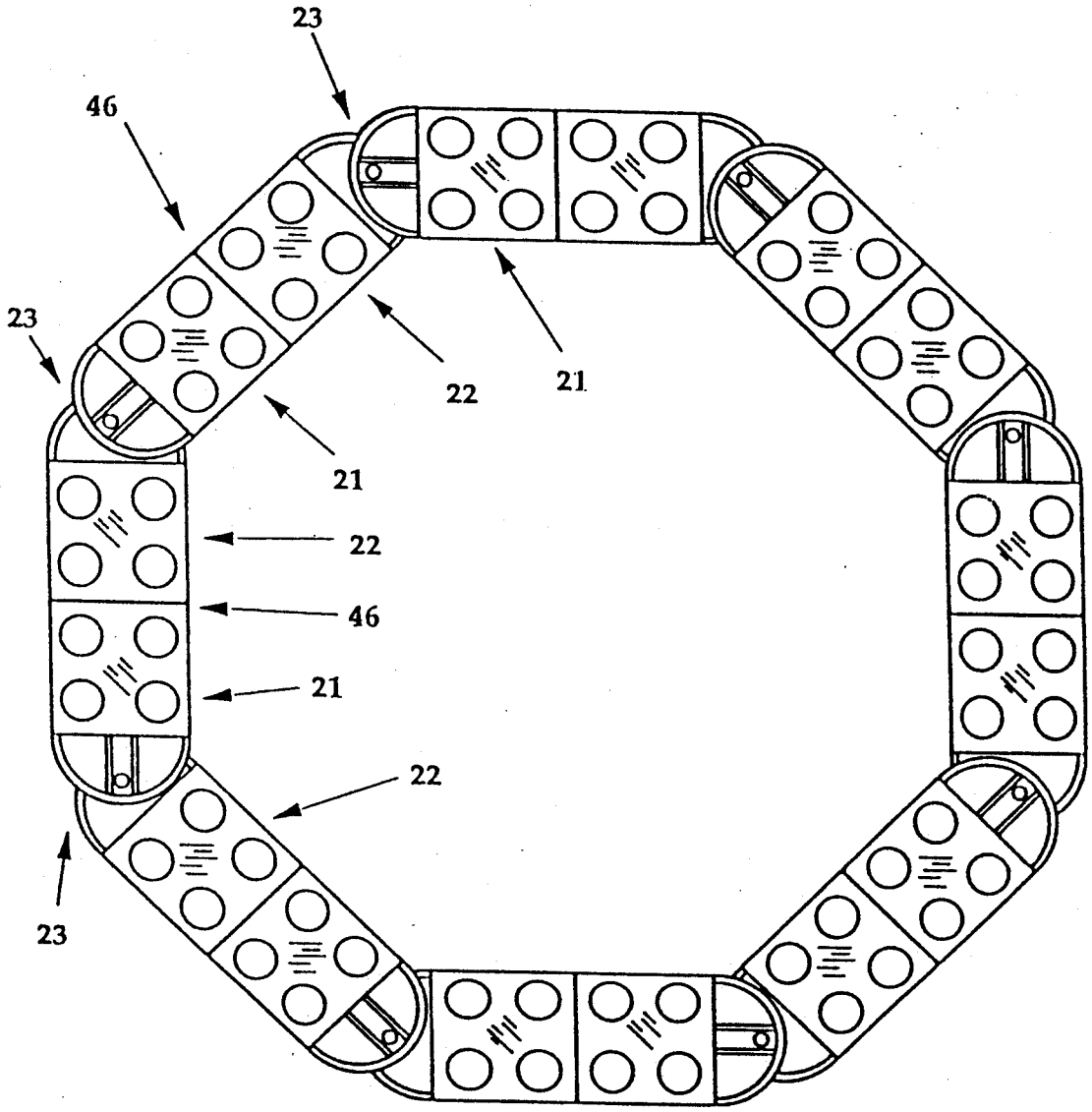
FIG. 17 depicts another construction which can be assembled from a series of the blocks.
Figure 18:
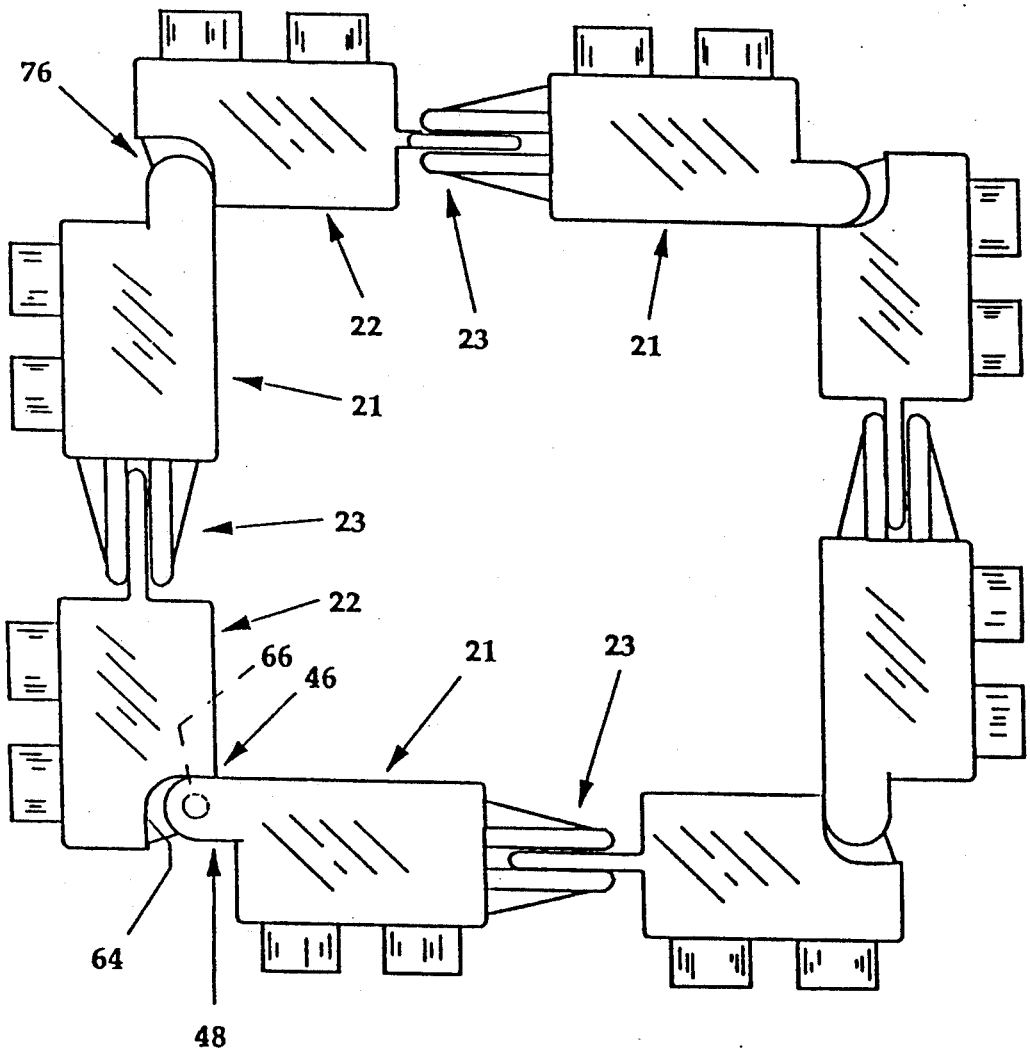
FIG. 18 illustrates a modification of the configuration of the interlocking blocks and also depicts another construction which can be assembled from such blocks.

As a further example, FIG. 17 illustrates a ring shaped construction of the blocks 21 and 22 in which a series of pairs of the first and second blocks are interlocked with each other at the first pivotable engagement means 23 with the component blocks of each pair being interlocked together at the second pivotable engagement means 46. Such a construction remains structurally intact while being deformable into various configurations both within the plane of the drawing and at right angles to the plane of the drawing. Moreover, such a construction is capable of a torsional deformability into a distinctively different configuration as shown in FIG. 18. The construction of FIG. 18 is structurally identical to that of FIG. 17 but the blocks 21 and 22 which are interlocked at the first pivotable engagement means 23 have been pivoted into alignment while blocks interlocked at the second pivotable engagement means 46 have been pivoted into a right angled orientation with each other.

Figure 19:
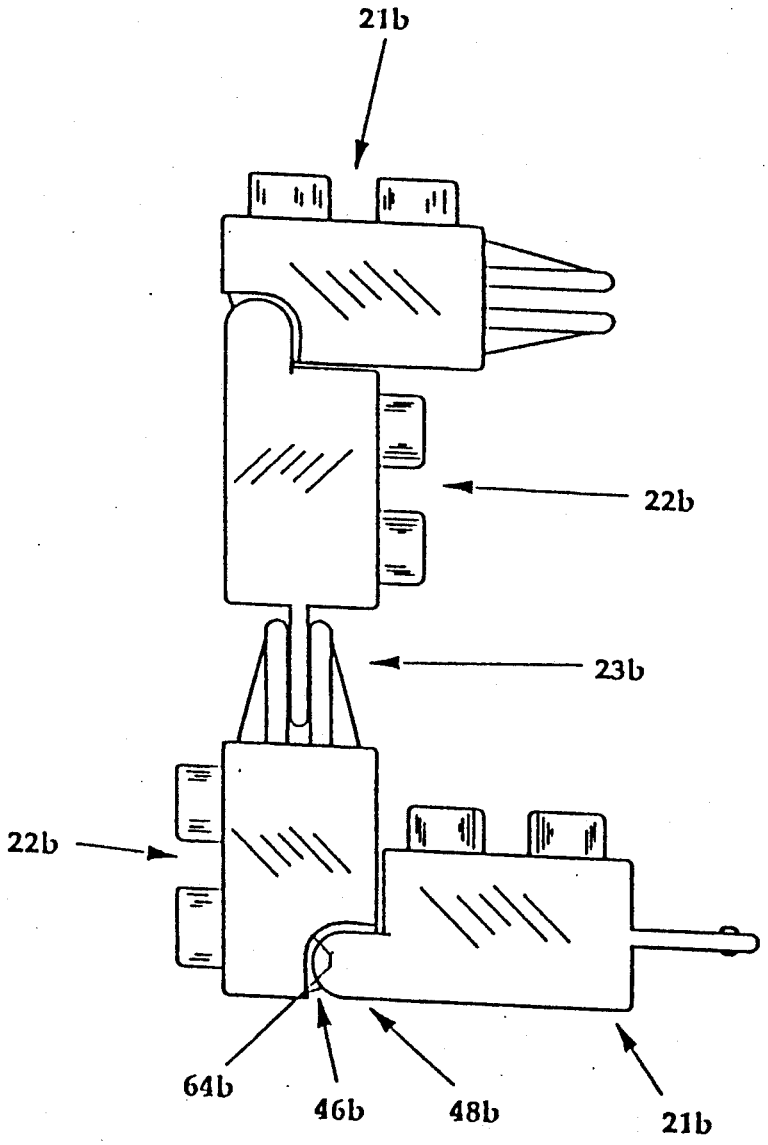

In the above described embodiment of the invention, hinge arms 48 are situated on the first block 21 and recesses 64 and apertures 66 are on the second block 22. As shown in FIG. 19, the hinge arms **48*b* may extend from the second blocks 22b while the hinge arm receiving recesses 64b are located on the first blocks 21b. FIG. 19 further illustrates an extension of the pivoting capabilities of constructions which include interlocking blocks 21b, 22b. As previously pointed out, the second pivotable engagement means 46b differs from the first pivotable engagement means 23 in that it enables pivoting of the blocks 21b, 22b away from an aligned condition in one direction only. As shown in FIG. 19, the direction in which pivoting occurs can be reversed by inverting one block 22b relative to the other block 21b prior to engagement of hinge arms 48b in recesses 64b**.

Figure 20:
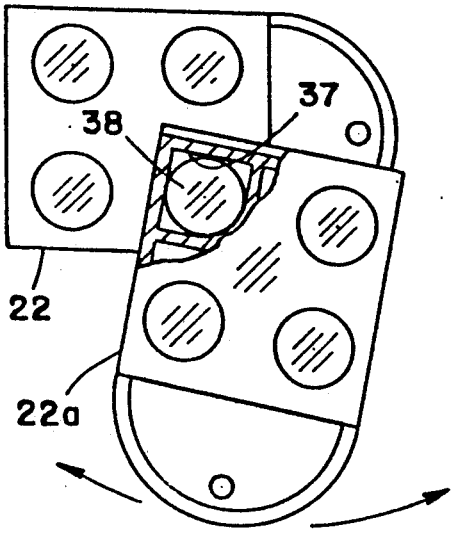
FIGS. 19, 20 and 21 illustrate still other ways of interconnecting the blocks.
Figure 21:
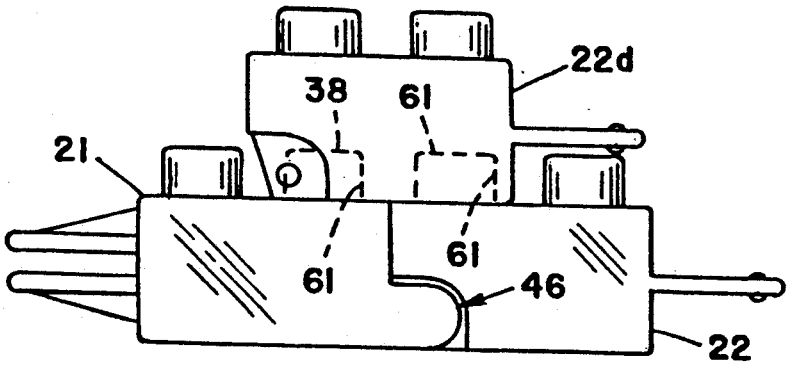

Referring to FIG. 20, blocks 21 and 22 of the hereinbefore described form can be interlocked together in still another manner that imparts flexibility to a block construction. In particular, a single one of the projections 38 of one block 22 can be engaged in one of the sockets 37 of the other block 22c to enable pivoting motion about the axis of the projection. Referring to FIG. 21, end to end linking of two blocks 21 and 22 in a non-pivotable manner can be effected by linking the blocks with the second pivotable engagement means 46 and then bridging the linked blocks 21 and 22 with another block 22d. A pair of the projections 38 of block 21 and a pair of the projections 61 of block 22 are engaged in the socket openings 61 of the bridging block 22d.

Figure 22:
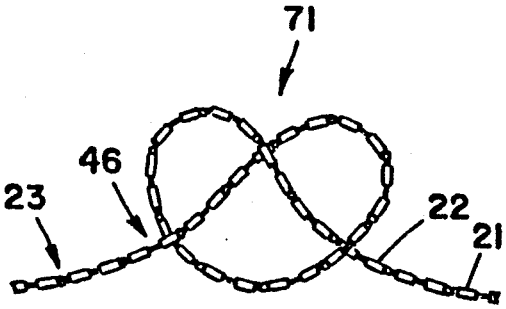
FIG. 22 depicts a flexible strand of the interconnected blocks which has been tied into a knot.

Referring to FIG. 22, the two pivotable engagement means 23 and 46 provide for pivoting of a single block 21 or 22 relative to adjoining blocks in either of two orthogonal directions. Flexibility of the block construction as a whole is not confined to those two directions. A strand 71 of blocks 21 and 22 that are interlocked end to end can in fact be tied in a knot.

While the invention has been described with reference to certain specific embodiments for purposes of example, many modifications and variations are possible and it is not intended to limit the invention except as defined in the following claims.

I claim:

1. A toy building block set having a plurality of interlockable blocks including a first block and a second block; each of said first and second blocks having opposite principal faces, opposite sides and opposite ends, an array of projections which extend outward from one of said principal faces and a matching array of sockets which extend inward from the other of said principal faces, said projections and sockets having configurations which enable engagement of the block with other blocks which have similar projections and sockets; wherein the improvement comprises:

said first and second blocks having first pivotable engagement means for temporarily fastening said first and second blocks together in an end to end relationship and which enables alignment of said first and second blocks and also enables sideward pivoting of said first block relative to said second block away from an aligned condition in each of two opposite directions, said pivoting being about a first pivot axis that extends in a direction that is orthogonal to said principal faces of said blocks.

2. The toy building block set of claim 1 wherein said first pivotable engagement means includes a pair of spaced apart surfaces at one end of said first block which jointly form a slot that extends transversely relative to said first block and a tongue which extends from one end of said second block and which is proportioned to be entered into said slot, and means for snap engaging said tongue to said surfaces at the location of said first pivot axis.

3. The toy building block set of claim 1 wherein said first pivotable engagement means includes a pair of spaced apart resilient blades extending outward from one end of said first block and each having an opening therein at the location of said first pivot axis and a tongue extending outward from one end of said second block and which is proportioned for insertion between said blades, said tongue having detent protuberances proportioned to spread said plates apart as said tongue is forced between said plates and to seat in said openings thereof when said protuberances are at the location of said first pivot axis said pair of blades having facing surfaces which are parallel to said principal faces of said first block and said tongue being parallel to said principles faces of said second block.

4. The toy building block of claim 3 wherein said detent protuberances each have a convex base region and a convex tip region extending therefrom which tip region is of smaller radius than said base region.

5. The toy building block set of claim 3 wherein the distal ends of said blades and said tongue have a substantially semi-circular configuration.

6. A toy building block set having a plurality of interlockable blocks including a first block and a second block; each of said first and second blocks having opposite principal faces, opposite sides and opposite ends, an array of projections which extend outward from one of said principal faces and a matching array of sockets which extend inward from the other of said principal faces, said projections and sockets having configurations which enable engagement of the block with other blocks which have similar projections and sockets; wherein the improvement comprises:

said first and second blocks having first pivotable engagement means for temporarily fastening said first and second blocks together in an end to end relationship and which enables alignment of said first and second blocks and also enables sideward pivoting of said first block relative to said second block away from an aligned condition in each of two opposite directions, said pivoting being about a first pivot axis that extends in parallel relationship with said projections;

further including second pivotable engagement means for temporarily fastening said first and second blocks to other blocks in an end to end relationship and which enables pivoting of said other blocks relative to said first and second blocks about second pivot axes that are orthogonal to said first pivot axis, said first and second pivotable engagement means being at opposite ends of said first and second blocks.

7. The toy building block set of claim 6 wherein said first pivotable engagement means prevents pivoting movement of said first block relative to said second block except for said pivoting movement about said first pivot axis and wherein said second pivotable engagement means prevents pivoting movement of each of said other blocks relative to the one of said first and second blocks to which the other block is fastened except for said pivoting movement about said orthogonal second pivot axis.

8. The toy building block set of claim 6 wherein said second pivotable engagement means enables said other blocks to be pivoted out of alignment with the one Of said first and second blocks to which the other block is fastened in one direction only.

9. The toy building block set of claim 6 wherein said first pivotable engagement means locates said first pivot axis in spaced apart relationship from said principle faces of said first and second blocks and wherein said second pivotable engagement means locates said said second pivot axes between said principal faces.

10. A toy building block set having a plurality of interlockable blocks including a first block and a second block; each of said first and second blocks having opposite principal faces, opposite sides and opposite ends, an array of projections which extend outward from one of said principal faces and a matching array of sockets which extend inward from the other of said principal faces, said projections and sockets having configurations which enable engagement of the block with other blocks which have similar projections and sockets; wherein the improvement comprises:

said first and second blocks having first pivotable engagement means for temporarily fastening said first and second blocks together in an end to end relationship and which enables alignment of said first and second blocks and also enables sideward pivoting of said first block relative to said second block away from an aligned condition in each of two opposite directions, said pivoting being about a first pivot axis that extends in parallel relationship with said projections;

wherein said first pivotable engagement means are at first ends of said first and second blocks and wherein a pair of spaced apart parallel resilient hinge arms extend outwardly from the opposite end of one of said first and second blocks, each of said arms having a knob thereon, and wherein the opposite end of the other of said first and second blocks has apertures in said sides thereof into which said knobs may be entered.

11. The toy building block set of claim 10 wherein said knobs and said apertures are positioned to be in register with each other when said opposite ends of said first and second blocks are abutted against each other and are located at corner regions of said first and second blocks whereby said first and second blocks may be pivoted out of alignment with each other about said second pivot axis in one direction only.

12. A toy building block set comprising:

first and second interlockable blocks each having opposite principal faces, opposite side surfaces and opposite end surfaces; each of said blocks having an array of sockets in one of said principal faces thereof and a matching array of projections on the other of said principal faces thereof which projections are proportioned to be frictionally engaged in other similar sockets; one of said blocks having a pair of resilient hinge arms extending outward from one end of the block at opposite sides thereof each of the arms having a knob thereon, the other of said blocks having apertures in said side surfaces at one end of the block which apertures are proportioned to receive and seat knobs of that kind; said first block having a pair of spaced apart blades which extend out from the end of said first block that is opposite from said one end thereof and which define a transversely extending slot at said opposite end of said first block, corresponding locations on each of said blade having an opening thereat; said second block having a transversely extending tongue which projects outward from the end of said second block that is opposite from said one end thereof, said tongue having a pair of detent protuberances situated on opposite surfaces thereof and which are proportioned to seat in said openings of said blades when said tongue is inserted into said slot.

13. The toy building block set of claim 12 wherein said apertures are situated at corner regions of said side surfaces of said one of said blocks and said hinge arms extend from corresponding corner regions of said other of said blocks and are proportioned to hold said one ends of said blocks in abutment when said knobs are seated in said apertures and said blocks are pivoted into alignment with each other, and wherein said openings in said blades are equidistant from said side surfaces of said first block and said detent protuberances are equidistant from said side surfaces of said second block.

14. A toy building block for releasable engagement with other blocks comprising a block body having opposite principal faces, opposite side surfaces and opposite end surfaces, said block body having an array of sockets in one of said principal faces and having a matching array of projections on the other of said principal faces which projections are proportioned to be entered into sockets of that kind and to frictionally engage therein, said block body further having means at one end thereof for fastening to an adjacent block which means enables pivoting of said block body relative to said adjacent block about a transverse pivot axis that extends in parallel relationship with said end surfaces of said block body and in orthognal relationship with said side surfaces thereof, and wherein a pair of blades extend outward from the opposite end of said block body and are spaced apart to define a transversely extending slot at said opposite end of said block body, said blades having openings situated at corresponding locations thereon which openings define another pivot axis that extends orthogonally relative to said transverse pivot axis.

15. A toy building block for releasable engagement with other blocks comprising a block body having opposite principal faces, opposite side surfaces and opposite end surfaces, said block body having an array of sockets in one of said principal faces and having a matching array of projections on the other of said principal faces which projections are proportioned to be entered into sockets of that kind and to frictionally engage therein, said block body further having means at one end thereof for fastening to an adjacent block which means enables pivoting of said block body relative to said adjacent block about a transverse pivot axis that extends between said sides of said block body, and wherein a transversely extending tongue projects outward from the opposite end of said block body, said tongue having opposite surfaces and detent protuberances at corresponding locations on said opposite surfaces which define another pivot axis that extends orthogonally relative to said transverse pivot axis.

* * * * *